US007497243B2

(12) United States Patent
Koyama et al.

(10) Patent No.: US 7,497,243 B2
(45) Date of Patent: Mar. 3, 2009

(54) MOLD FOR CASTING AND METHOD FOR MANUFACTURE THEREOF

(75) Inventors: Hiroaki Koyama, Tochigi-ken (JP); Toshihiro Miyauchi, Tochigi-ken (JP); Yasuhiro Shimamura, Utsunomiya (JP); Michiharu Hasegawa, Mie-ken (JP); Naoji Yamamoto, Shizuoka-ken (JP); Masahito Hasuike, Hamamatsu (JP); Noriyuki Miyazaki, Hamamatsu (JP); Hiroaki Tohyama, Kumamoto (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/532,692

(22) PCT Filed: Oct. 28, 2003

(86) PCT No.: PCT/JP03/13758

§ 371 (c)(1),
(2), (4) Date: Jan. 3, 2006

(87) PCT Pub. No.: WO2004/039518

PCT Pub. Date: May 13, 2004

(65) Prior Publication Data

US 2006/0151139 A1 Jul. 13, 2006

(30) Foreign Application Priority Data

Oct. 30, 2002 (JP) ..... 2002-316266

(51) Int. Cl.
*B22D 17/22* (2006.01)

(52) U.S. Cl. ..... 164/113; 164/284

(58) Field of Classification Search ..... 164/312, 164/284, 306, 113, 120; 249/135
See application file for complete search history.

(56) References Cited

U.S. PATENT DOCUMENTS

| | | | | | |
|---|---|---|---|---|---|
| 2,495,064 | A | * | 1/1950 | Horvath | 249/52 |
| 3,848,847 | A | * | 11/1974 | Komatsu et al. | 249/115 |
| 4,497,359 | A | * | 2/1985 | Suzuki et al. | 164/120 |
| 5,522,448 | A | * | 6/1996 | Righi | 164/122 |
| 5,711,363 | A | * | 1/1998 | Scruggs et al. | 164/113 |
| 6,306,467 | B1 | * | 10/2001 | White et al. | 427/470 |

(Continued)

FOREIGN PATENT DOCUMENTS

CN 2180362 Y * 10/1994

(Continued)

*Primary Examiner*—Kevin P Kerns
(74) *Attorney, Agent, or Firm*—Carrier, Blackman & Associates, P.C.; William D. Blackman; Joseph P. Carrier

(57) ABSTRACT

A mold for casting primarily of SMC420, wherein a cavity forming portion comprising maraging steel, which has the toughness and the resistance to heat shock superior to those of SMC420, is provided in a vertical wall heading for a cavity surface from a molten metal inlet and a portion nearest to the molten metal inlet in the cavity surface, which are portions suffering relatively large heat shock in the contact with a molten metal. Also provided is a method for providing the cavity forming portion, which comprises filling a concave portion of the mold with a molten metal prepared by melting a welding rod by arc welding, in other words, carrying out an overlaying welding, and then cooling and solidifying the molten metal.

6 Claims, 5 Drawing Sheets

U.S. PATENT DOCUMENTS 6,561,258 B1 * 5/2003 Kumpula ..... 164/113

FOREIGN PATENT DOCUMENTS

| | | |
|---|---|---|
| JP | 08-174215 | 7/1996 |
| JP | 2000-301542 | 10/2000 |
| JP | 2001-079645 | 3/2001 |
| JP | 2001-150098 | 6/2001 |
| JP | 2001-179394 | 7/2001 |
| JP | 2002-121643 | 4/2002 |
| JP | 2002-248597 | 9/2002 |

* cited by examiner

MOLD FOR CASTING AND METHOD FOR MANUFACTURE THEREOF

TECHNICAL FIELD

The present invention relates to a casting die and a method of manufacturing a casting die, and more particularly to a casting die including a portion which needs to be resistant to thermal shocks, the portion being constructed of a separate member, so that a main body of the casting die which is different from the separate member will be replaced less frequently than the separate member, and hence castings can be manufactured by the casting die at a lower cost, and a method of manufacturing such a casting die.

BACKGROUND ART

For producing a casting such as of aluminum according to a casting process, molten aluminum is poured into a casting die. Since the molten aluminum is of a high temperature, the casting die is generally made of an SKD61 material (Japanese Industrial Standard for representing an alloy tool steel) which is of excellent strength at high temperatures.

If a casting die suffers heat cracking, then it is difficult to produce aluminum castings of desired dimensional accuracy from the casting die. Stated otherwise, the yield of aluminum castings from the casting die becomes low. Accordingly, when heat cracking occurs even in a portion of a casting die, the casting die needs to be replaced with a new one even though the remaining portion of the casting die is free of any heat cracks. Since casting dies are generally expensive, however, the manufactured aluminum castings become highly costly if they are produced from frequently replaced casting dies.

Heat cracking occurs in a casting die when the temperature of the casting die changes abruptly by contact with a high-temperature molten metal that is poured into the casting die, i.e., when the casting die is subjected to a thermal shock. Consequently, casting dies are required to be resistant to thermal shocks.

To make casting dies resistant to thermal shocks, the casting dies are usually processed by surface treatments. Specifically, casting dies are coated with a ceramic layer such as of TiC, TiN, or the like by a salt bath process, a nitriding process such as a gas nitriding process or an ionitriding process, a physical vapor deposition (PVD) process, or a chemical vapor deposition (CVD) process, or coated with a layer comprising a mixture of iron sulfide and iron nitride by a sulphonitriding process, or coated with an oxide layer of iron oxide by an oxidizing process.

However, it is difficult to greatly increase the service life of casting dies even if they are processed by the above surface treatments. Specifically, portions of casting dies which are subject to intensive heat shocks, e.g., mold recesses that are present in the vicinity of a gate for receiving an introduced molten metal, of all mold recesses having a horizontal side wall which extends horizontally and a vertical bottom wall which extends substantially vertically, are susceptible to heat cracks even though they are coated with layers applied by the above surface treatments.

It has been proposed to apply carburizing to mold portions that are to be resistant to thermal shocks, as disclosed in Japanese Laid-Open Patent Publication No. 2002-121643. However, the proposed carburizing process fails to greatly increase the thermal shock resistance of carburized mold portions, and to greatly lower the cost of castings that are manufactured by the carburized casting dies.

SUMMARY OF THE INVENTION

It is a major object of the present invention to provide a casting die which will be replaced less frequently and makes it possible to lower the cost of castings produced by the casting die, and a method of manufacturing such a casting die.

According to an aspect of the present invention, there is provided a casting die comprising a main body having a wall surface for defining a mold cavity, and a cavity forming member having a wall serving as a portion of the mold cavity, the main body being made of steel, the cavity forming member being made of a material which is better with respect to at least one of toughness, hardness, and thermal conductivity than the steel which the main body is made of.

The material which is better with respect to at least one of toughness, hardness, and thermal conductivity than the steel which the main body is made of, is generally better also with respect to thermal shock resistance. Therefore, the portion of the casting die where the cavity forming member is provided has excellent toughness and thermal shock resistance, i.e., is resistant to heat cracks. The casting die thus has a long service life, and will be replaced less frequently than general casting dies. As a result, the cost of castings produced by the casting die of the present invention is lowered.

Though the material which has the excellent properties as described above is generally expensive, the cavity forming member which is made of the above material is used in only a portion of the mold cavity. Consequently, the casting die is prevented from becoming expensive.

Preferred examples of the steel of the main body include an SCM material and an SKD material. Of these materials, the SCM material is preferable because it is cheaper and can make the casting die more inexpensive.

An SCM420 material, which is a type of the SCM material, is widely used as the material of molds for producing molded plastic articles, as well known in the art. However, since the service life of casting dies made of the SCM420 material is not sufficient in applications where molten metals are cast, it has been difficult to use the SCM420 material as the material of casting dies for casting molten metals.

The cavity forming member is made of a material selected from the group consisting of maraging steel, an SKH material, a copper alloy, and a ceramic material, which are of higher toughness than the SCM material and the SKD material.

The cavity forming member may be provided as an insert die.

If the mold cavity is bent or curved from a gate for receiving an introduced molten metal, then the cavity forming member should preferably be disposed in a position closest to the gate. Stated otherwise, the cavity forming member should preferably be disposed in a position in the mold cavity which is open to relatively large thermal shocks.

The cavity forming member made of a material which has excellent thermal shock resistance is disposed in the position which is open to relatively large thermal shocks. Therefore, the casting die is resistant to heat cracks.

According to another aspect of the present invention, there is also provided a method of manufacturing a casting die having a main body having a wall surface for defining a mold cavity, and a cavity forming member having a wall serving as a portion of the mold cavity, the method comprising the steps of forming a main body of steel with a mold cavity defined thereby, defining a recess in a portion of the mold cavity, and placing a cavity forming member made of a material which is better with respect to at least one of toughness, hardness, and thermal conductivity than the steel which the main body is made of, in the recess in the main body.

With the above method, the casting die can easily be manufactured simply by defining the recess and thereafter placing the cavity forming member in the recess. Stated otherwise, placing the cavity forming member in the recess does not make the process of manufacturing the casting die complex or troublesome. Therefore, the cost to manufacture the casting die and hence the cost to produce castings from the casting die are prevented from increasing.

According to still another aspect of the present invention, there is further provided a method of manufacturing a casting die having a main body having a wall surface for defining a mold cavity, and a cavity forming member having a wall serving as a portion of the mold cavity, the method comprising the step of placing, in a portion of the mold cavity in the main body which has been used in a casting process, a cavity forming member made of a material which is better with respect to at least one of toughness, hardness, and thermal conductivity than steel which the main body is made of.

With the above method, a casting die which has suffered a heat crack in a previous casting process and which fails to produce a casting of desired dimensional accuracy can be recycled for reuse. Accordingly, the service life of the casting die can be further increased for further reducing the cost of castings produced from the casting die.

The cavity forming member may comprise an overlay deposited by a welding process using a welding rod. With this arrangement, since there is no boundary formed between the main body and the cavity forming member, heat transfer from the cavity forming member to the main body will not be obstructed.

Alternatively, the cavity forming member may comprise an insert die fitted in or joined to the main body. The cavity forming member in the form of an insert die can be produced more simply and easily than it is produced as an overlay deposited by a welding process.

If the mold cavity is bent or curved from a gate for receiving an introduced molten metal, then the cavity forming member should preferably be disposed in a position which is open to relatively large thermal shocks, i.e., a position closest to the gate.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF BEST MODE FOR CARRYING OUT THE INVENTION

The casting die and the method of manufacturing same of the present invention will be explained in detail below with reference to the accompanying drawings as exemplified by preferred embodiments.

Figure 1:
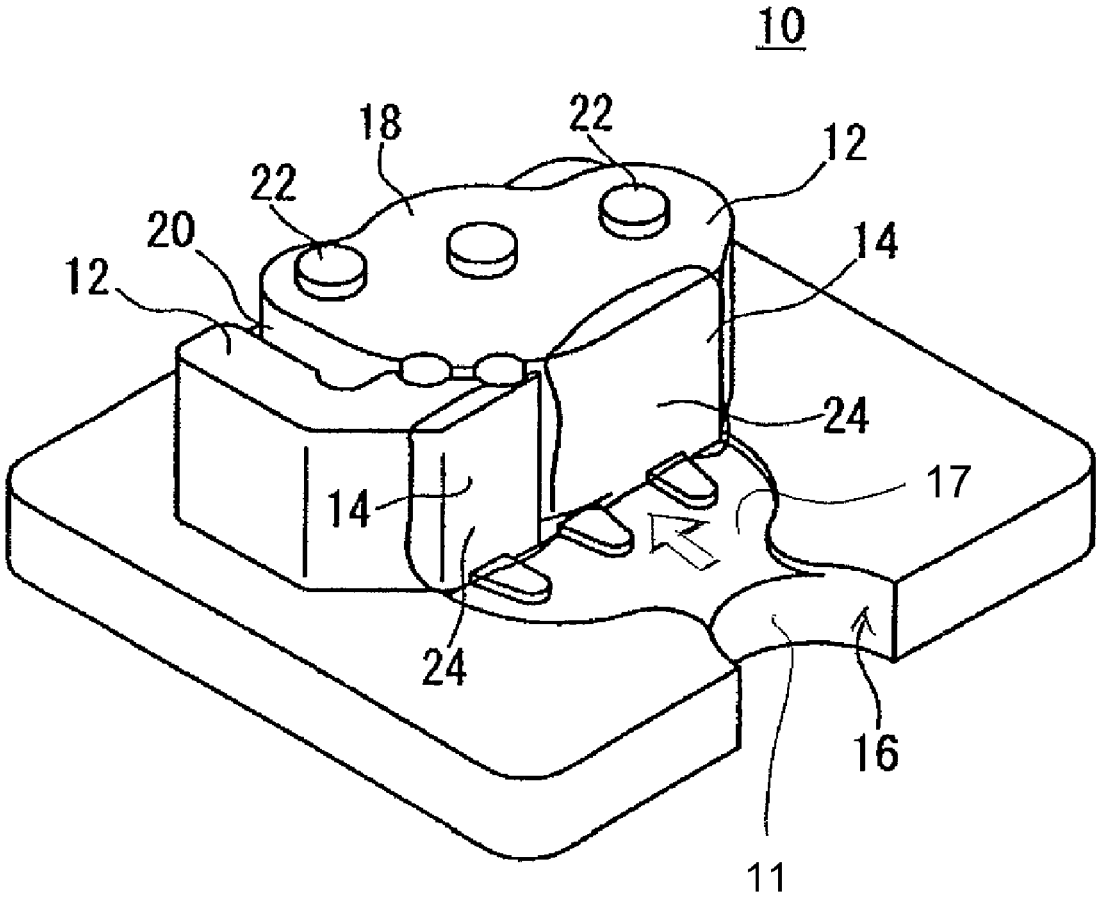
FIG. 1 is a perspective view of a casting die (movable mold) according to an embodiment of the present invention.
Figure 2:
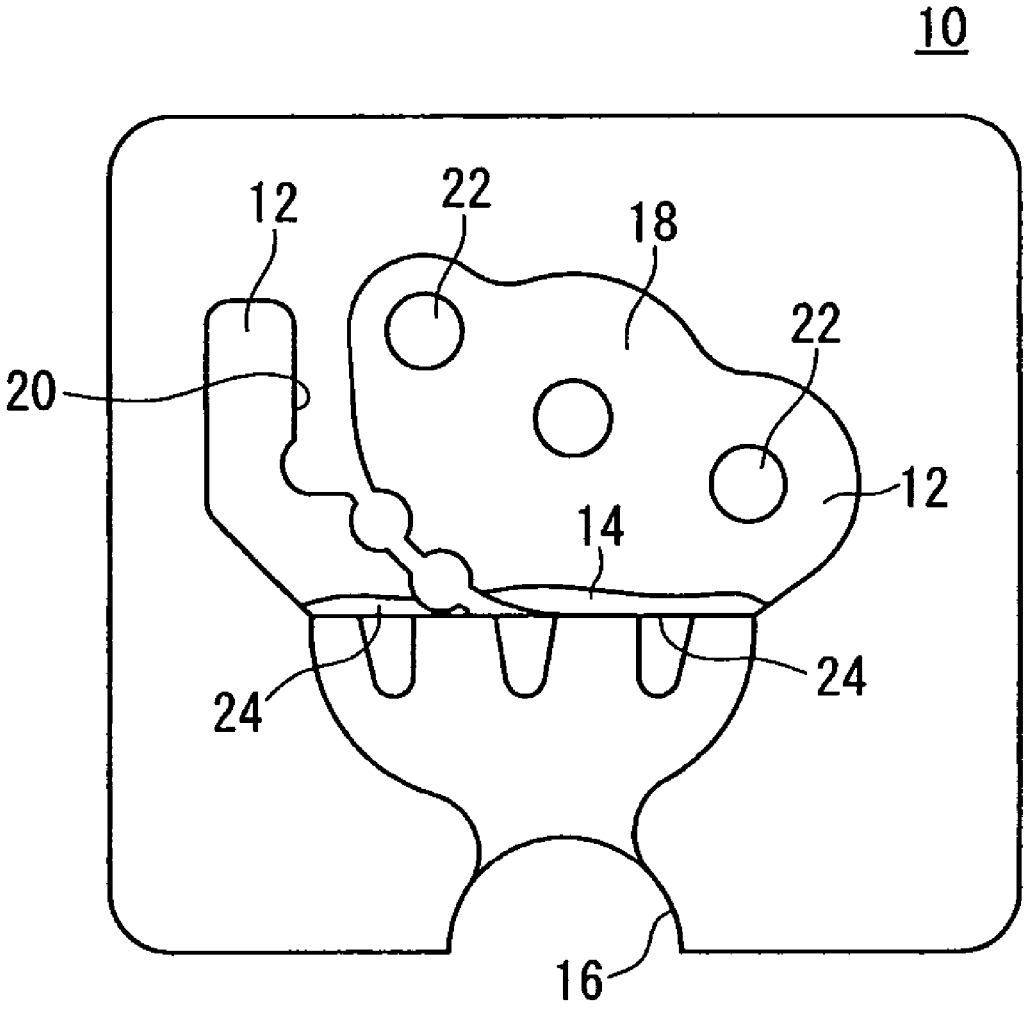
FIG. 2 is a plan view of the casting die shown in FIG. 1.

FIG. 1 shows in perspective a casting die 10 according to an embodiment of the present invention, and FIG. 2 shows in plan the casting die 10. The casting die 10, which serves as a movable mold, is combined with a fixed mold (not shown) to form a mold cavity therebetween for casting an automotive transmission case. The casting die 10 comprises a main body 12 and a cavity forming member 14 joined to the main body 12 by welding.

The main body 12 is made of an SCM420 material which is pre-hardened steel. The main body 12 has a gate 16 defining a flow path for routing molten metal entering the mold. The flow path is disposed at a first level and defines an initial flow direction, indicated by the arrow in FIG. 1. The gate 16 includes an entry port 11 located at a peripheral edge of the main body 12, and also includes a substantially fork-shaped routing channel 17 extending from the entry port 11 to a vertical flow-receiving wall 24. As shown in FIG. 1, the routing channel 17 begins with a first, relatively narrow width at the entry port 11, and then opens out to an expanded width as it moves further inward. The main body 12 also includes a cavity surface 18 disposed at a level above the flow path. The cavity surface 18 extends substantially perpendicularly to the flow-receiving wall 24 for defining the mold cavity. Since the SCM420 material is inexpensive as well known in the art, the casting die 10 is inexpensive.

The gate 16 is disposed in a lower portion of the casting die 10. Therefore, according to the present embodiment, a molten metal is poured into the mold cavity from the lower portion of the casting die 10.

The cavity surface 18 has a horizontally oriented recess 20 and convexities 22 for shaping an automotive transmission case.

As noted above, the cavity forming member 14 provides a vertical flow-receiving wall 24 (also referred to herein as vertical wall 24) extending from an inner portion of the routing channel 17 to the cavity surface 18. The cavity forming member 14 (cavity-forming reinforcement member) has an upper end serving as a portion of the cavity surface 18 that is closest to the gate 16. The upper end of the cavity forming member 14 serves as part of the cavity surface 18.

The cavity forming member 14 is made of a welded metal that is deposited as an overlay by an arc welding (or build-up welding) process using a welding rod. Specifically, the cavity forming member 14 is made of maraging steel which is more resistant to thermal shocks than the SCM420 material that the main body 12 is made of.

In the present embodiment, therefore, the vertical wall 24 extending from the gate 16 to the cavity surface 18 and the portion of the cavity surface 18 that is closest to the gate 16 are provided by the cavity forming member 14 of the material which is more resistant to thermal shocks than the material that the main body 12 of the casting die 10 is made of.

A casting process using the casting die 10 according to the present embodiment is carried out in the same manner as a casting process using a general casting die. First, the casting die 10 that operates as a movable mold is brought into close contact with the non-illustrated fixed mold, and these molds are fastened together, producing a mold cavity for casting an automotive transmission case.

After the casting die 10 and the fixed mold are preheated, a molten metal is poured through the gate 16 into the mold cavity.

At this time, the molten metal flows from the gate 16 along the vertical wall 24 to the cavity surface 18. Therefore, the high-temperature molten metal that is poured is instantaneously brought into contact with the cavity forming member 14. The cavity forming member 14 is subjected to a thermal shock that is larger than a thermal shock applied to the other portion of the cavity surface 18.

As described above, the cavity forming member 14 has excellent resistance to thermal shocks. Consequently, since the cavity surface 18 and the portion of the cavity surface 18 that is closest to the gate 16 have sufficient thermal shock resistance, the casting die 10 is prevented from suffering heat cracks, and hence is expected to have a long service life.

As the molten metal is continuously poured into the mold cavity, a portion of the cavity surface 18 which is remote from the gate 16 has its temperature increased by the heat that is transferred from the molten metal that has already been poured. Since the portion of the cavity surface 18 which is remote from the gate 16 is subjected to a smaller thermal shock, that portion of the cavity surface 18 is not required to have the cavity forming member 14 that is comparatively expensive. Accordingly, the cost of the casting die 10 is prevented from becoming high.

When the mold cavity is filled up with the molten metal, the pouring of the molten metal is finished. Thereafter, the mold assembly is left for a predetermined period of time to cool and solidify the molten metal into an automotive transmission case as a casting.

Then, the casting die 10 is moved away from the fixed mold, and the automotive transmission case is removed from the fixed mold.

Then, the automotive transmission case is deburred, and the gate 16 and other extra portions are removed from the automotive transmission case, whereupon the automotive transmission case is available as a final product.

As described above, the casting die 10 according to the present embodiment has excellent resistance to thermal shocks. Even when the above casting process is repeatedly performed on the casting die 10, the casting die 10 is less susceptible to heat cracks than general casting dies. Therefore, the casting die 10 can repeatedly be used over a long period of time. Specifically, while a general casting die starts to suffer heat cracks when it has been repeatedly used about 2000 times, the casting die 10 can be repeatedly used about 4000 times before it suffers heat cracks. Stated otherwise, the frequency with which the casting die 10 must be replaced is greatly reduced, so that investments for the casting facility using the casting die 10 may be reduced and hence the cost of castings produced using the casting die 10 may also be lowered.

The casting die 10 is manufactured as follows: First, an ingot of steel is cut and ground into the main body 12 having the cavity surface 18 and the gate 16 of rough dimensions.

Figure 3:
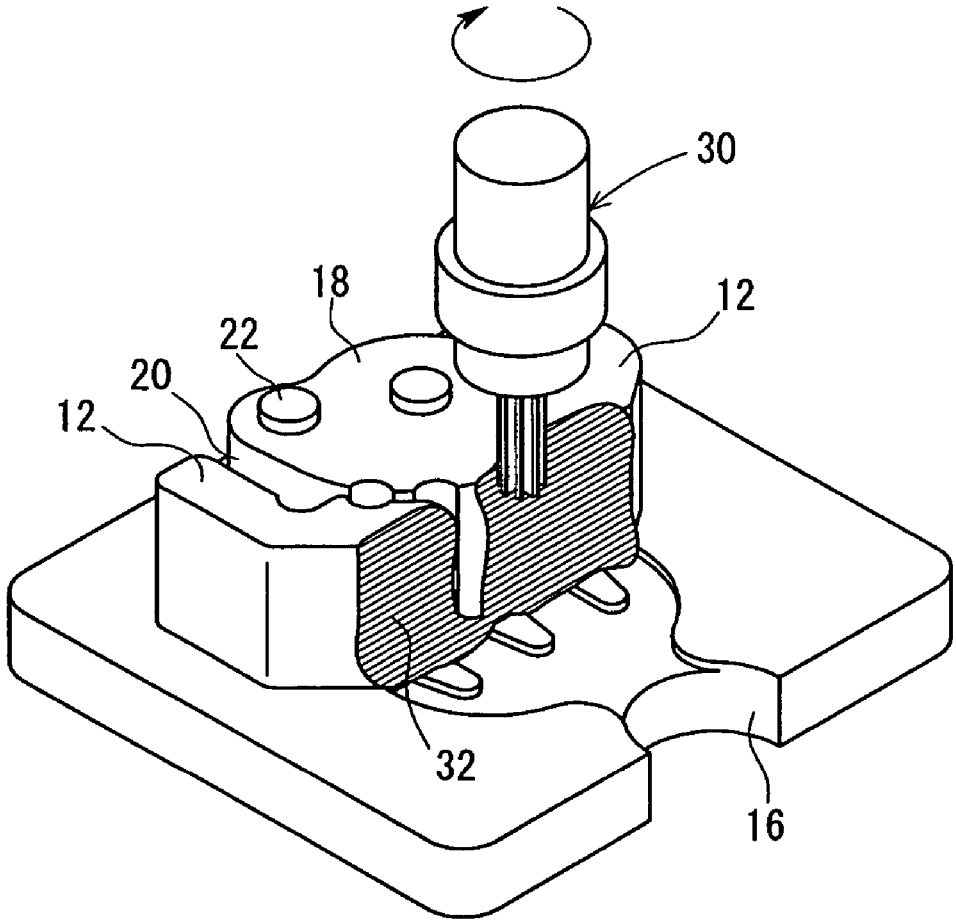
FIG. 3 is a perspective view showing the manner in which a recess is formed in a main body of the casting die.

Then, as shown in FIG. 3, the portion of the main body 12 where the cavity forming member 14 is to be formed, i.e., the wall of the main body 12 that extends substantially vertically upwardly from the gate 16, is machined by an end mill 30, producing a recess 32.

Figure 4:
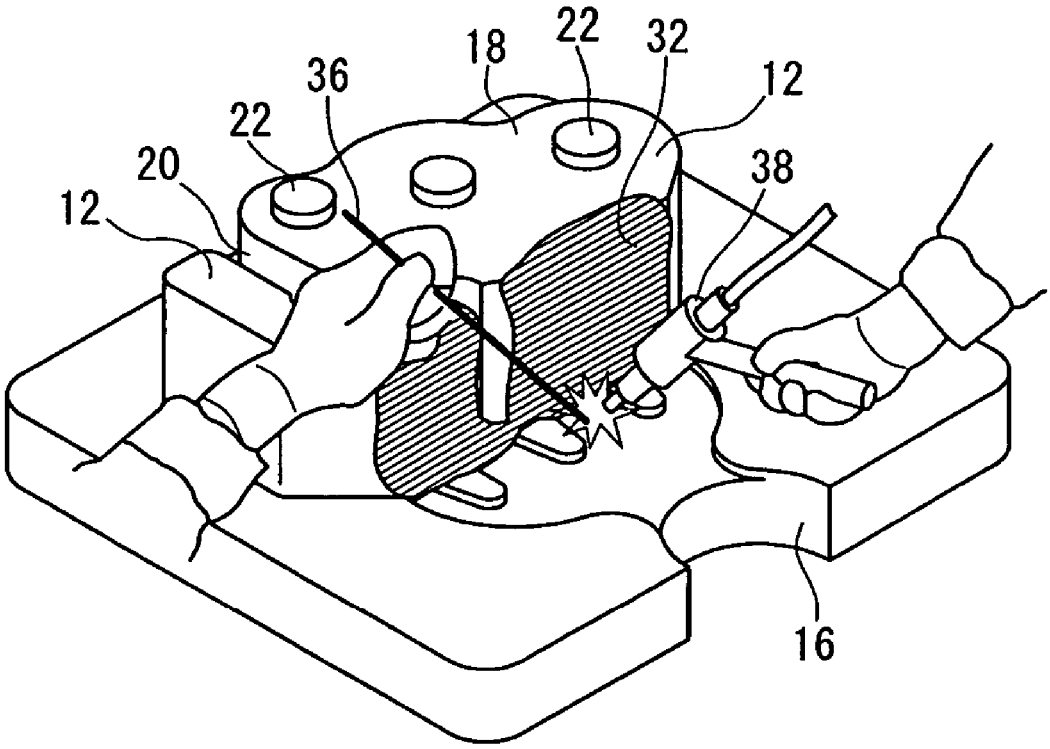
FIG. 4 is a perspective view showing the manner in which a cavity forming member is placed in the recess.

Then, as shown in FIG. 4, a welding rod 36 made of maraging steel is melted by an arc welding gun 38, filling up the recess 32 with the molten metal from the welding rod 36. Stated otherwise, an overlay of maraging steel is deposited in the recess 32. Then, the deposited overlay is cooled and solidified into the cavity forming member 14, i.e., the cavity forming member 14 is buried in the recess 32.

Figure 5:
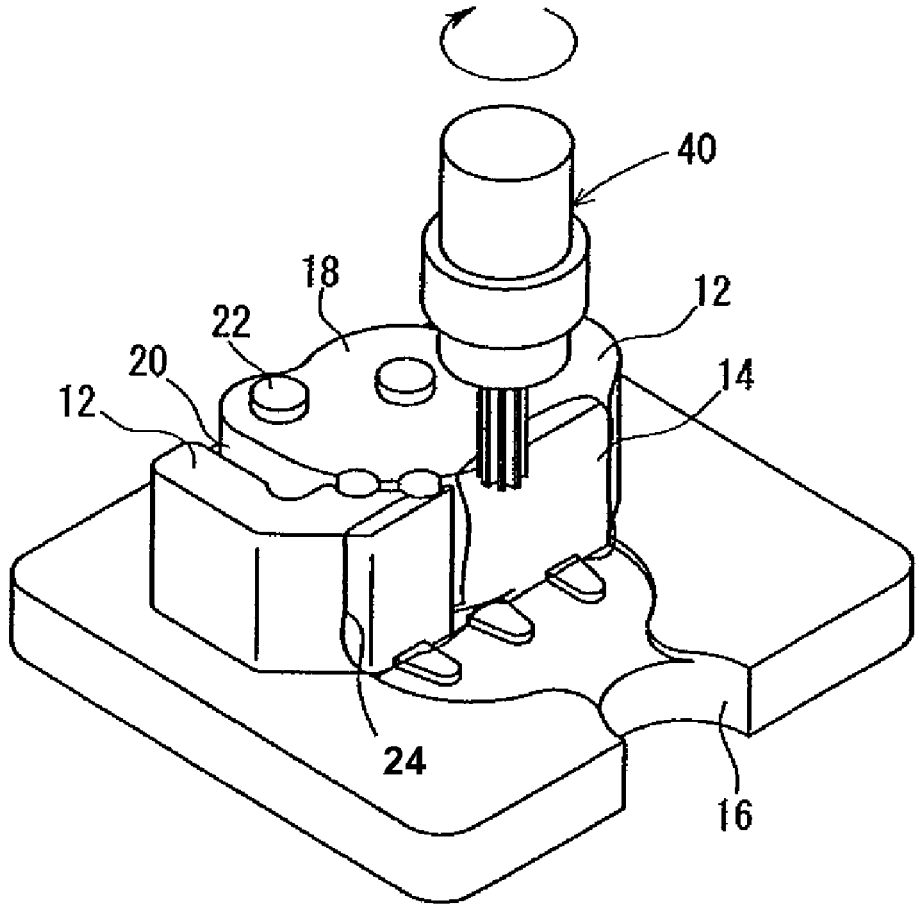
FIG. 5 is a perspective view showing the manner in which the cavity forming member is cut.

Then, as shown in FIG. 5, the exposed surface of the cavity forming member 14 is finished by an end mill 40. That is, the cavity forming member 14 is cut to provide the vertical wall 24 for producing an automotive transmission case of desired dimensional accuracy. In this manner, the cavity surface 18 for shaping an automotive transmission case is formed on the casting die 10.

If necessary, the casting die 10 is subjected to a surface treatment such as a nitriding process, a sulphonitriding process, or an oxidizing process, thus improving various properties, such as hardness, toughness, etc., of the main body 12 and the cavity forming member 14 which are made of steel.

The main body 12 may be a one which has already been used to produce castings. If the main body 12 has suffered a heat crack from a previous casting process, then the cavity forming member 14 is provided in place of the portion of the main body 12 which has such a heat crack. The cavity forming member 14 may be provided in the same manner as described above.

Therefore, the casting die 10 which has suffered a heat crack because of a repetition of casting processes can be recycled for reuse. The service life of the casting die 10 is thus increased to lower the cost with which to manufacture automotive transmission cases.

With the above manufacturing process according to the present embodiment, the casing die 10 of long service life can be manufactured simply by forming the recess 32 in the cavity surface of the main body 12 and placing the cavity forming member 14 in the recess 32.

In the illustrated embodiment, the recess 32 is filled up with molten metal of the welding rod 36, and thereafter the molten metal is cooled and solidified into the cavity forming member 14. However, a plate member (insert die) of maraging steel may be fitted in the recess 32, and the plate member fitted in the recess 32 may be joined to the main body 12 by welding or the like.

The cavity forming member 14 may be made of an SKH material of high hardness or a Cu alloy of good thermal conductivity instead of the maraging steel. The cavity forming member 14 made of such an alternative material may be formed using a welding rod, or may be formed as a plate member (insert die) fitted in the recess 32, which may be joined to the main body 12 by welding or the like.

Further alternatively, the cavity forming member 14 may be made of a ceramic material. The ceramic cavity forming member 14 may be formed by a plasma powder welding process. The plasma powder welding process may be employed to form the cavity forming member 14 of maraging steel, an SKH material, or a Cu alloy.

The main body of the casting die may be made of an SKD material which is used to make general casting dies.

As described above, a cavity forming member which is better with respect to at least one of toughness, hardness, and thermal conductivity than a main body of a casting die is formed in a portion of a mold cavity, particularly a portion that is open to relatively large thermal shocks. The casting die thus constructed is resistant to heat cracks, and will be replaced with new ones less frequently. As a result, investments for the casting facility using the casting die may be reduced and hence the cost of castings produced using the casting die may also be lowered.

Although there has been described what is the present embodiment of the invention, it will be understood that modifications and variations may be made thereto within the spirit and scope of the invention as reflected in the appended claims.

The invention claimed is:

1. A casting die for metal casting, said casting die comprising:

a main body having a wall surface for defining a portion of a mold cavity, said main body comprising:

a gate defining an initial flow path for routing molten metal, wherein said initial flow path is disposed at a first level and defines an initial flow direction, and a flow-receiving wall extending away from said first level in a direction substantially transverse to said initial flow direction; and a cavity forming reinforcement member having a wall serving as a portion of the mold cavity, said cavity forming reinforcement member being permanently fused to said flow-receiving wall of said main body;

said main body being made of steel, the steel being equivalent to steels designated as an SCM material or an SKD material;

said cavity forming reinforcement member being made of maraging steel or a steel equivalent to steels designated as an SKH material which is better with respect to at least one of toughness, hardness, and thermal conductivity than the SCM material or the SKD material which said main body is made of, wherein the material designations are as designated by Japanese Industrial Standards.

2. A casting die for metal casting according to claim 1, wherein said mold cavity is bent or curved from a gate for receiving an introduced molten metal, and said cavity forming reinforcement member is disposed adjacent to said gate.

3. A method of manufacturing a casting die for metal casting having a main body having a wall surface for defining a mold cavity, and a cavity forming reinforcement member having a wall serving as a portion of the mold cavity, said method comprising the steps of:

forming a main body of steel with a mold cavity defined thereby, said main body comprising:

a gate defining an initial flow path for routing molten metal, wherein said initial flow path is disposed at a first level and defines an initial flow direction, and a flow-receiving wall extending away from said first level in a direction substantially transverse to said initial flow direction;

defining a recess in a portion of said mold cavity;

placing a cavity forming reinforcement member made of a material which is better with respect to at least one of toughness, hardness, and thermal conductivity than the steel which said main body is made of, in said recess in said main body, and permanently fusing said cavity forming reinforcement member to said flow-receiving wall of said main body through welding, wherein said cavity forming reinforcement member is formed by depositing material on a face of the mold cavity through welding.

4. A method according to claim 3, wherein said mold cavity is bent or curved from a gate for receiving an introduced molten metal, and said cavity forming reinforcement member is disposed adjacent to said gate.

5. A method of manufacturing a casting die for metal casting having a main body having a wall surface for defining a mold cavity, and a cavity forming reinforcement member having a wall serving as a portion of the mold cavity, comprising the steps of:

placing, in a portion of the mold cavity in said main body which has been used in a casting process, a cavity forming reinforcement member made of a material which is better with respect to at least one of toughness, hardness, and thermal conductivity than a steel which said main body is made of, wherein said main body comprises:

a gate defining an initial flow path for routing molten metal, wherein said initial flow path is disposed at a first level and defines an initial flow direction, and a flow-receiving wall extending away from said first level in a direction substantially transverse to said initial flow direction; and permanently fusing said cavity forming reinforcement member to said flow-receiving wall of said main body through welding, and wherein said cavity forming reinforcement member is formed by depositing material on a face of the mold cavity through welding.

6. A method according to claim 5, wherein said mold cavity is bent or curved from a gate for receiving an introduced molten metal, and said cavity forming reinforcement member is disposed adjacent to said gate.

* * * * *